US007995089B2

(12) United States Patent
Pepe

(10) Patent No.: US 7,995,089 B2
(45) Date of Patent: Aug. 9, 2011

(54) MOTOR POLYGON ASSEMBLY (MPA) FACET REFLECTIVITY MAPPING

(75) Inventor: Martin Pepe, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 147 days.

(21) Appl. No.: 11/601,498

(22) Filed: Nov. 16, 2006

(65) Prior Publication Data

US 2008/0117281 A1 May 22, 2008

(51) Int. Cl.
*B41J 27/00* (2006.01)

(52) U.S. Cl. ..... 347/261

(58) Field of Classification Search ..... 347/246–250, 347/231, 259–261, 234–237, 243; 250/205, 250/236

See application file for complete search history.

(56) References Cited

U.S. PATENT DOCUMENTS

| | | | | | |
|---|---|---|---|---|---|
| 4,443,695 | A * | 4/1984 | Kitamura | 250/205 |
| 4,831,247 | A * | 5/1989 | Ishizaka | 250/205 |
| 5,438,354 | A | 8/1995 | Genovese | 347/256 |
| 5,475,210 | A * | 12/1995 | Taguchi et al. | 250/205 |
| 5,498,869 | A * | 3/1996 | Appel et al. | 250/236 |
| 5,561,285 | A * | 10/1996 | Sakata et al. | 250/205 |
| 5,750,986 | A | 5/1998 | Genovese | 250/235 |
| 5,818,507 | A | 10/1998 | Genovese | 347/261 |
| 5,900,901 | A * | 5/1999 | Costanza et al. | 347/248 |
| 6,078,347 | A * | 6/2000 | Nukui | 347/246 |
| 6,344,866 | B1 | 2/2002 | Komiya et al. | 347/133 |
| 6,710,793 | B1 * | 3/2004 | Tanimoto et al. | 347/235 |
| 6,909,731 | B2 * | 6/2005 | Lu | 372/29.01 |
| 7,158,163 | B2 * | 1/2007 | Komiya et al. | 347/224 |
| 2003/0063183 | A1 * | 4/2003 | W. AuYeung et al. | 347/246 |

* cited by examiner

*Primary Examiner* — Hai C Pham

(74) *Attorney, Agent, or Firm* — Kermit D. Lopez; Luis M. Ortiz; Melissa Asfahani

(57) ABSTRACT

A technique for minimizing motor polygon assembly output reflectivity using real time facet reflectivity measurements and mapping. An automatic power control sensor manages laser beams produced by the laser source associated with the system during overscan periods 'outside' of defined printing time. Errors are then recorded internal to the raster output scanner to minimize overall setup in the image output terminal.

4 Claims, 5 Drawing Sheets

MOTOR POLYGON ASSEMBLY (MPA) FACET REFLECTIVITY MAPPING

TECHNICAL FIELD

Embodiments are generally related to image data processing. Embodiments are also related to the field of laser scanning. Embodiments are additionally related to minimizing MPA output reflectivity variation by real-time facet reflectivity measurement and mapping.

BACKGROUND OF THE INVENTION

Processes and devices used for electro photographic printers wherein a laser scan line is projected onto a photoconductive surface are known. In the case of laser printers, facsimile machines, and the like, it is common to employ a raster output scanner (ROS) as a source of signals to be imaged on a pre-charged photoreceptor (a photosensitive plate, belt, or drum) for purposes of xerographic printing. The ROS provides a laser beam which switches on and off as it moves, or scans, across a photoreceptor.

Commonly, the surface of the photoreceptor is selectively imaged and discharged by the laser in locations to be printed. On-and-off control of the beam to create the desired latent image on the photoreceptor is facilitated by digital electronic data controlling of the laser source. A common technique for effecting this scanning of the beam across the photoreceptor is to employ a rotating polygon mirror surface; the laser beam from the ROS is reflected by the facets of the polygon, creating a scanning motion of the beam, which forms a scan line across the photoreceptor. A large number of scan lines on a photoreceptor together form a raster of the desired latent image. Once a latent image is formed on the photoreceptor, the latent image is subsequently developed with a toner, and the developed image is transferred to a copy sheet, as in the well-known process of xerography.

While several exposure systems have been developed for use in electro photographic marking, one commonly used system is the raster output scanner (ROS). A raster output scanner is comprised of a laser beam such that the laser beam contains image information, a rotating polygon mirror having one or more reflective surfaces, a motor polygon assembly, etc. Some raster output scanners employ more than one laser beam. Usually in motor polygon assembly (MPA), errors may occur during manufacturing. Based upon these errors erratic beam reflectivity may occur from each facet in a ROS Imager MPA assembly that is then passed on to ROS outputs as dysfunctions in critical applications.

Laser scanning is based on a technique achieving both start-of-scan detection and dynamic beam intensity regulation in a multiple laser beam raster output scanner using a photodetector. The raster output scanner includes a source, or sources, of a plurality of laser beams or arrays, a rotating polygon having at least one reflecting facet for sweeping the laser beams to form a scan line path, and a photodetector for receiving illumination from the multiple laser beams and for converting those beams into beam-dependent electrical currents. The raster output scanner further includes a scan detection circuit for producing a start-of-scan signal, and a beam intensity circuit for producing an electrical output signal which depends upon the beam intensity of each laser beam. Optionally the raster output scanner also can include an optical fiber 102 that collects a portion of the light flux in the sweeping laser beams which directs the light flux onto the photo detector. Referring to FIG. 1 (prior-art) the top view 100 of a raster output scanner used in the electro photographic printing machine is illustrated. The raster output scanning assembly 100 can include a plurality of laser diodes or array (s) 150 and 151 which produce laser beams 103 and 104, respectively, are modulated according to image data from the data source and laser driver 152. The image data from the data source and laser driver 152 might originate from an input scanner, a computer, a facsimile machine, a memory device, or any of a number of other image data sources.

The purpose of the data source and laser driver 152 is to excite lasers 150 and 151 with modulated drive currents such that the desired electrostatic latent image is interlaced on the photoreceptor in precise registration with uniform exposure. The output flux from laser diodes 150 and 151 are collimated by optical elements 154, reflected by fold mirror 156, and focused on reflective facets 157 of rotating polygon 158 by cylindrical lens 160. The facets of rotating polygon 158 deflect the beams which are then focused into well defined spots focused on the surface of photoreceptor 10 by scan lens elements 162 and 164. As the polygon rotates, the focused spots trace parallel raster scan lines on the surface of the photoreceptor. The sensor network 106 is positioned in the scan path to collect light flux from beams 103 and 104 at the beginning of the scan. Optionally, the input end of the optical fiber 102 is positioned in the scan path to collect light flux from beams 103 and 104 at the beginning of the scan. The optical fiber 102 transmits the intercepted flux to the sensor network 106. Beam intensity signal 110 and the start of scan signals are configured from the sensor network 106 to the data source and laser driver 152. The synchronized input 122 is configured to the sensor network 106.

The present inventor has recognized a drawback of prior art of laser scanning is with lack in effectively controlling the output intensity variation of exposing beam(s) of a rotating polygon type image forming apparatus using control marks formed on a rotating surface portion of a polygon member or a motor polygon assembly. Ideally, control marks can be read by a reader during rotation of the polygon member, and the information read from the control marks is used to control the modulation of the exposing beam of the image forming apparatus to expose evenly spaced, uniformly sized, precisely oriented, geometrically straight scan lines of pixels on a photosensitive member. The control marks can include pixel clock information, intensity correction information, error correction information about individual facets of the polygon member, and motor speed control information.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved image data processing.

It is another aspect of the present invention to provide for improved system performance in using a raster output scanner.

It is a further aspect of the present invention to provide a solution that minimizes motor polygon assembly (MPA) output reflectivity differences by real time facet reflectivity measurement and mapping.

The aforementioned aspects and other objectives and advantages can now be achieved as described herein. In this present method the errors in MPA manufacturing diminishes erratic beam reflectivity that may occur from each facet in a ROS Imager MPA and that are passed on to ROS outputs (dysfunctions) in critical applications. Accordingly, a laser beam is passed to facets of the rotating polygon mirror that is configured with MPA then to an automatic power controller (APC) that provides the sensing during the process of image data scanning. The output beam is then sent from the APC when scanning is in process while the over scanning period is being defined as the process progress.

This present solution minimizes MPA output reflectivity by real time facet reflectivity measurement and mapping. The polygon facets are set setup with the help of the motor polygon assembly. A automatic power control (APC) sensor looks at the beam of the laser during over scan periods 'outside' of printing time. Errors are recorded internal to the ROS to minimize overall setup in image output terminal (IOT) manufacturing. The graphical output when analyzed from the processing of this method gives better output. The percentage of rise in the digitized signal can be analyzed with the rotation of the polygon facets.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
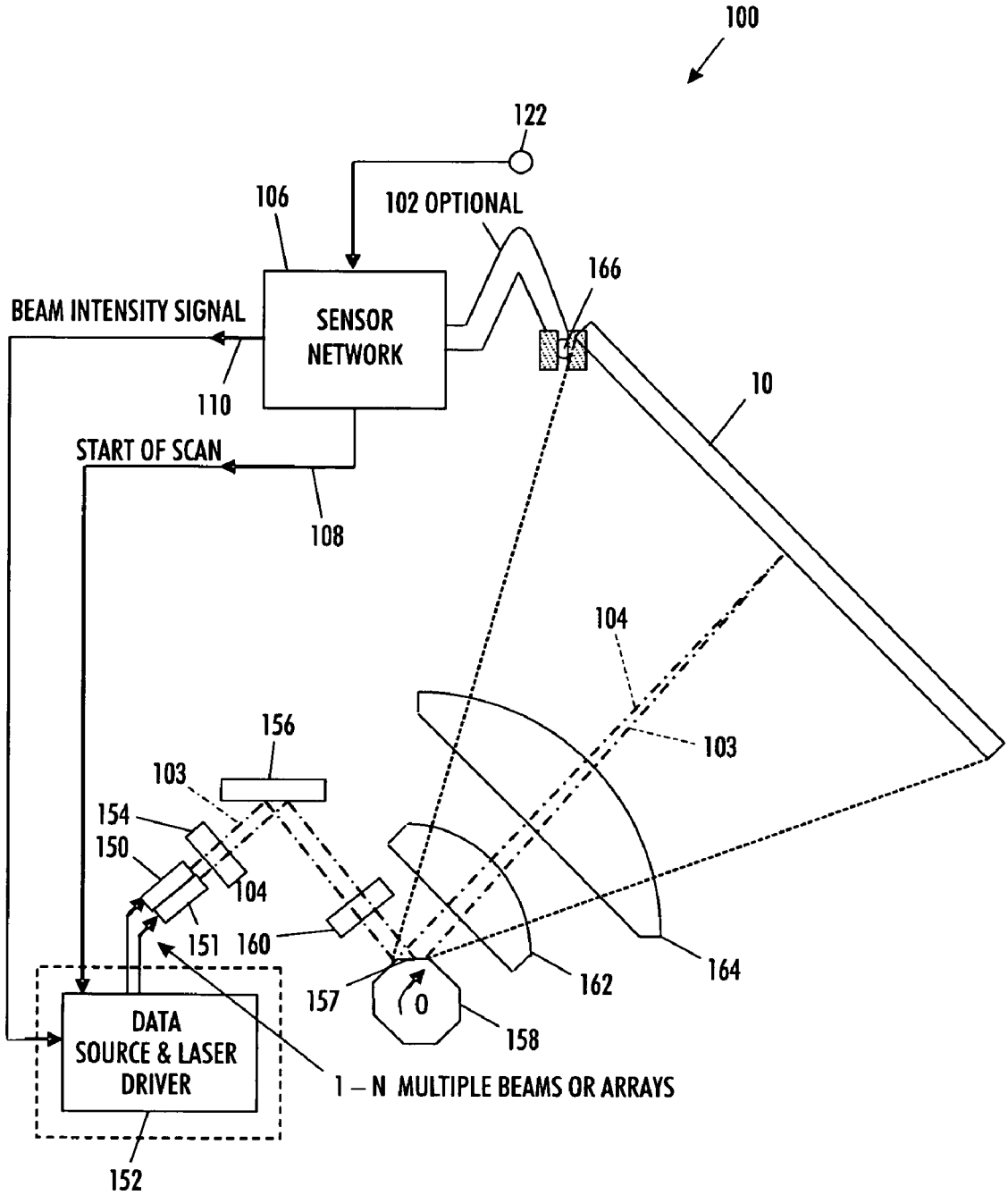
FIG. 1 illustrates a prior art the top view 100 of a raster output scanner used in the electro photographic printing machine is illustrated, in motor polygon assembly (MPA) facet reflectivity mapping, which can be implemented in accordance with a preferred embodiment.
Figure 2:
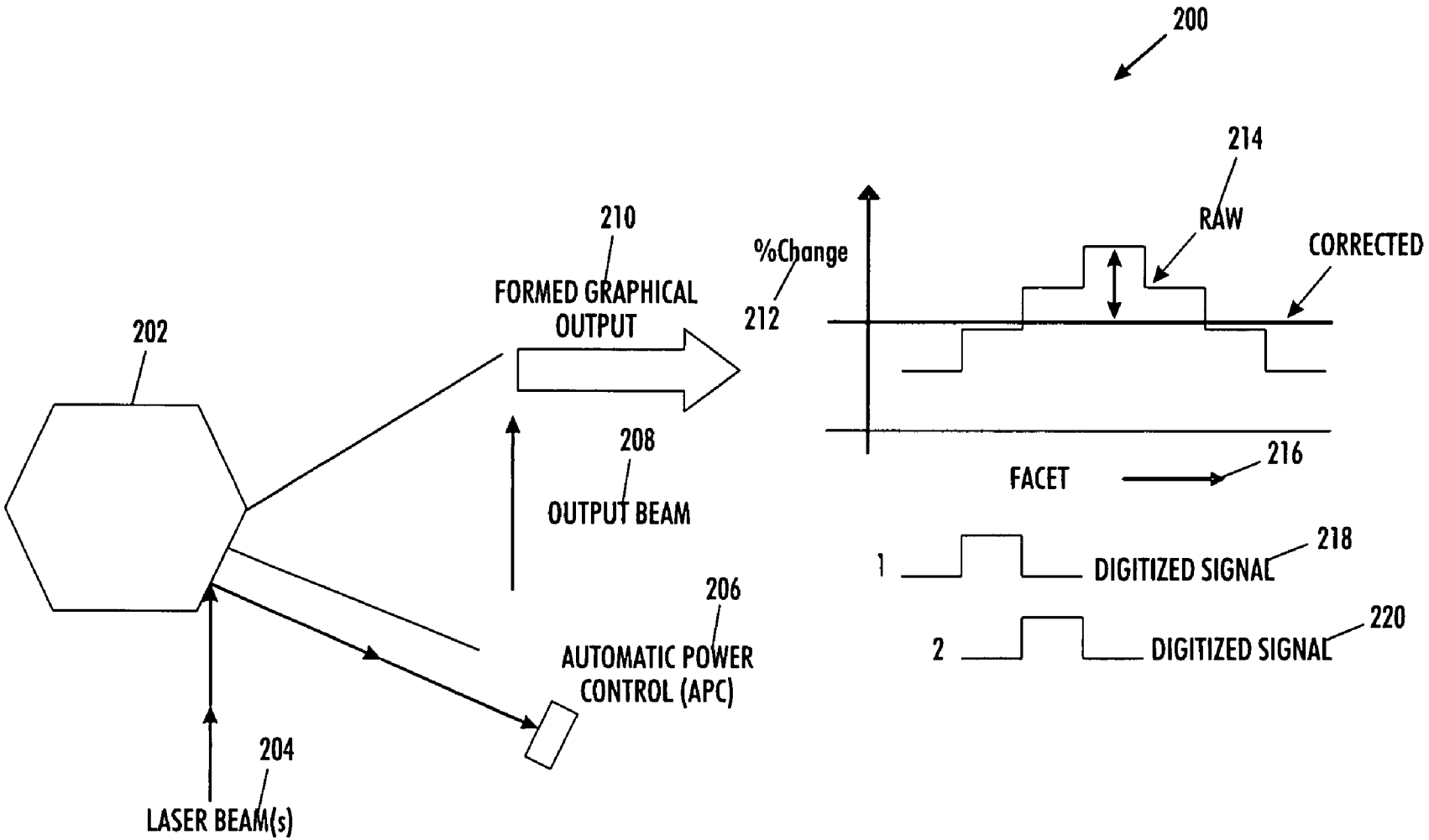
FIG. 2 illustrates a perspective view with the formed graphical analysis of the method adopted with motor polygon assembly (MPA) facet reflectivity mapping, which can be implemented in accordance with a preferred embodiment.

Referring to FIG. 2, illustrated is a perspective view 200 with the formed graphical analysis of the method adopted with motor polygon assembly (MPA) facet reflectivity mapping, which can be implemented in accordance with a preferred embodiment. A rotating polygon mirror 202 is kept adjacent to its facets, in which the laser beam is transmitted. The rotating polygon is configured with the help of the polygon motor driver and the response is generated to the automatic power control (APC) 206. The laser beam 204 is sent to the facets of the rotating polygon. The output beam 208 is configured and sent with the help of the automatic power control (APC). During the process the formed graphical output 210 is shown. The percentage of change 212 is analyzed in the vertical axis of the graph and the polygon facets 216 are analyzed in the horizontal axis of the graph. The raw portion 214 is shown in the graph. The digitized signal 218, 220 can also figured out from the graph representation.

Figure 3:
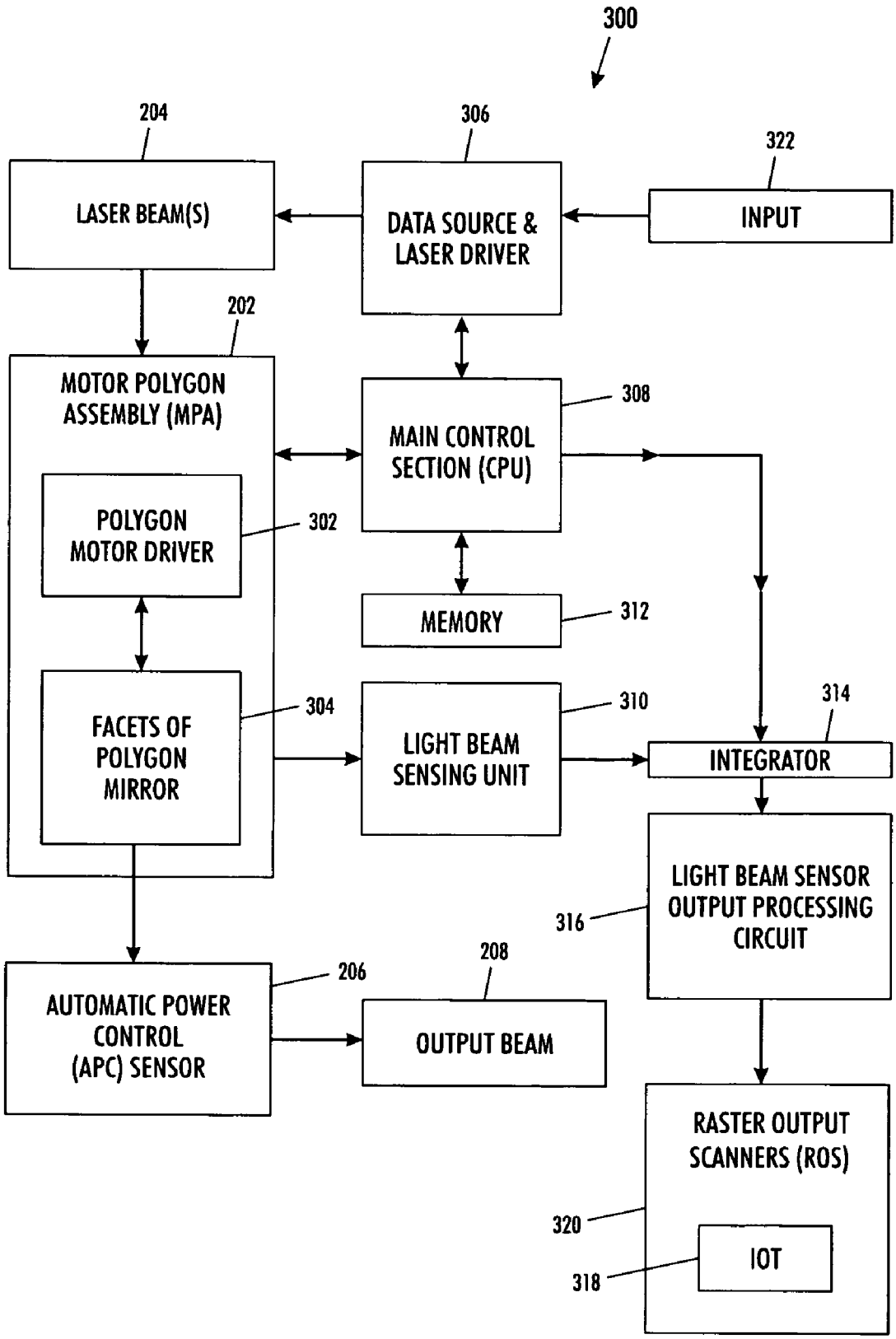
FIG. 3 illustrates a block diagram of the system, in motor polygon assembly (MPA) facet reflectivity mapping, which can be implemented in accordance with a preferred embodiment.

Referring to FIG. 3, illustrated is a block diagram 300 of a system, in motor polygon assembly (MPA) facet reflectivity mapping, which can be implemented in accordance with a preferred embodiment. It is understood that the generated laser beam 204 is sent to the motor polygon assembly 202 which consists of the polygon motor driver 302 wherein the facets of the polygon mirror 304 can be configured with the help of the polygon motor driver. The polygon motor driver is used in the functionality of the rotation of the facets of the polygon mirror. The motor polygon assembly can be configured to the automatic power control (APC) 206 sensor and sets up the output beam 208. The data source and laser driver 306 is setup with the input device 322. The data source and laser driver 306 is connected to the laser beam 204 and the main control section 308 that includes a memory 312. The main control section (CPU) is configured with the motor polygon assembly 202 and it sets up the generation of the laser beam 204. The main control section (CPU) is also integrated to the integrator 314 that connects the light beam sensing unit 310 with the light beam sensor output processing circuit 316. The light beam sensor output processing circuit forms the interface for the output unit that is configured with the raster output scanners (ROS) wherein the IOT 318 is set up for the processing of the image data.

Figure 4:
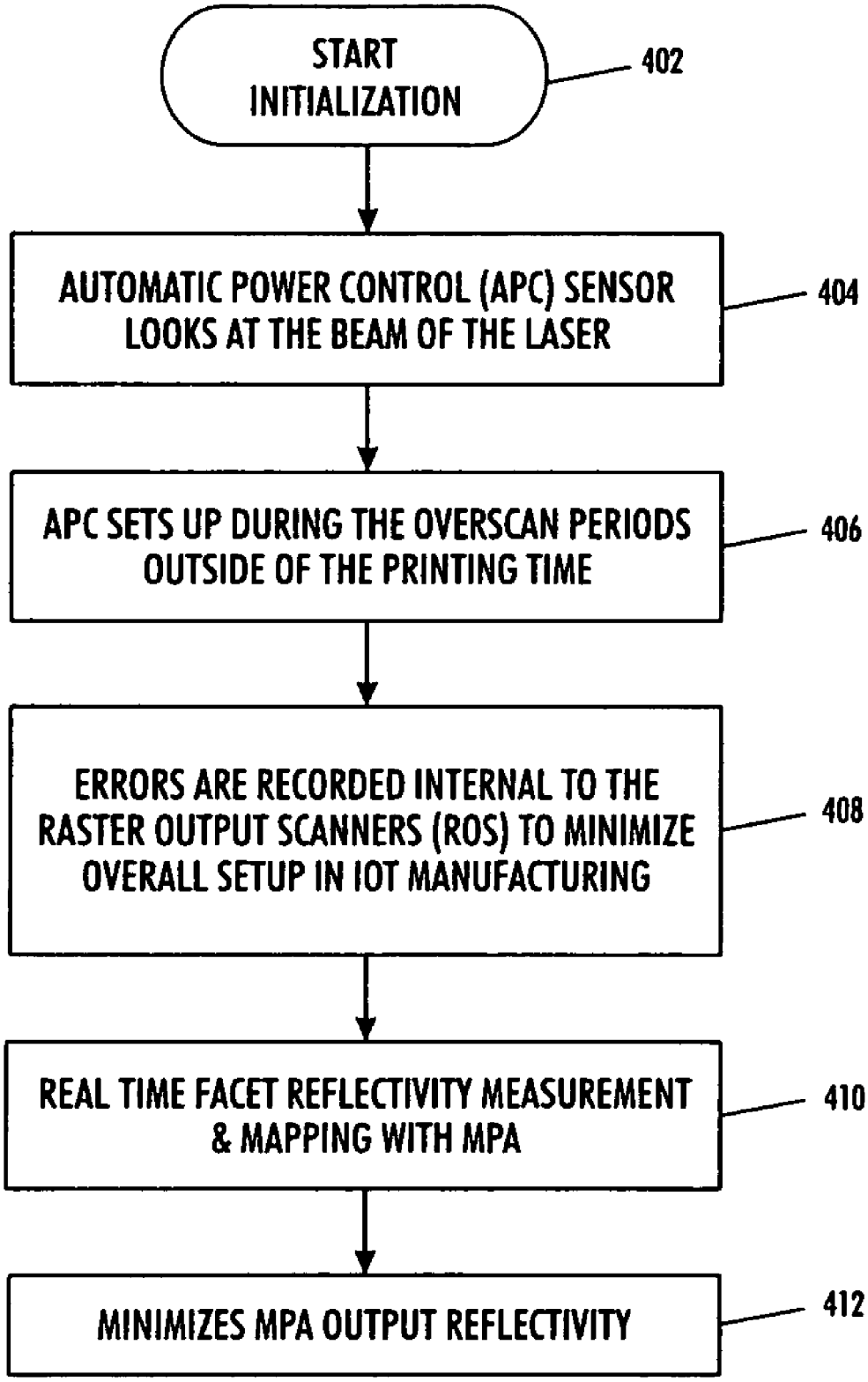
FIG. 4 illustrates a high-level flow chart showing the functional steps with a motor polygon assembly (MPA) facet reflectivity mapping, in accordance with a preferred embodiment.

Referring to FIG. 4, illustrated is a high-level flow chart 400 showing the functional steps with a motor polygon assembly (MPA) facet reflectivity mapping, in accordance with a preferred embodiment. As depicted at block 402, initialization can occur. Next, as indicated at block 404, the automatic power control (APC) sensor looks at the beam of laser. Thereafter, as described in block 406, the APC sets up during the over scan periods outside of the printing time. The errors formed are recorded internal to the raster output scanners (ROS) to minimize overall setup in IOT manufacturing as depicted in block 408, following processing of the operation involves real time facet reflectivity measurement & mapping with MPA as depicted in block 410 and finally minimizes MPA output reflectivity as described in block 412.

Figure 5:
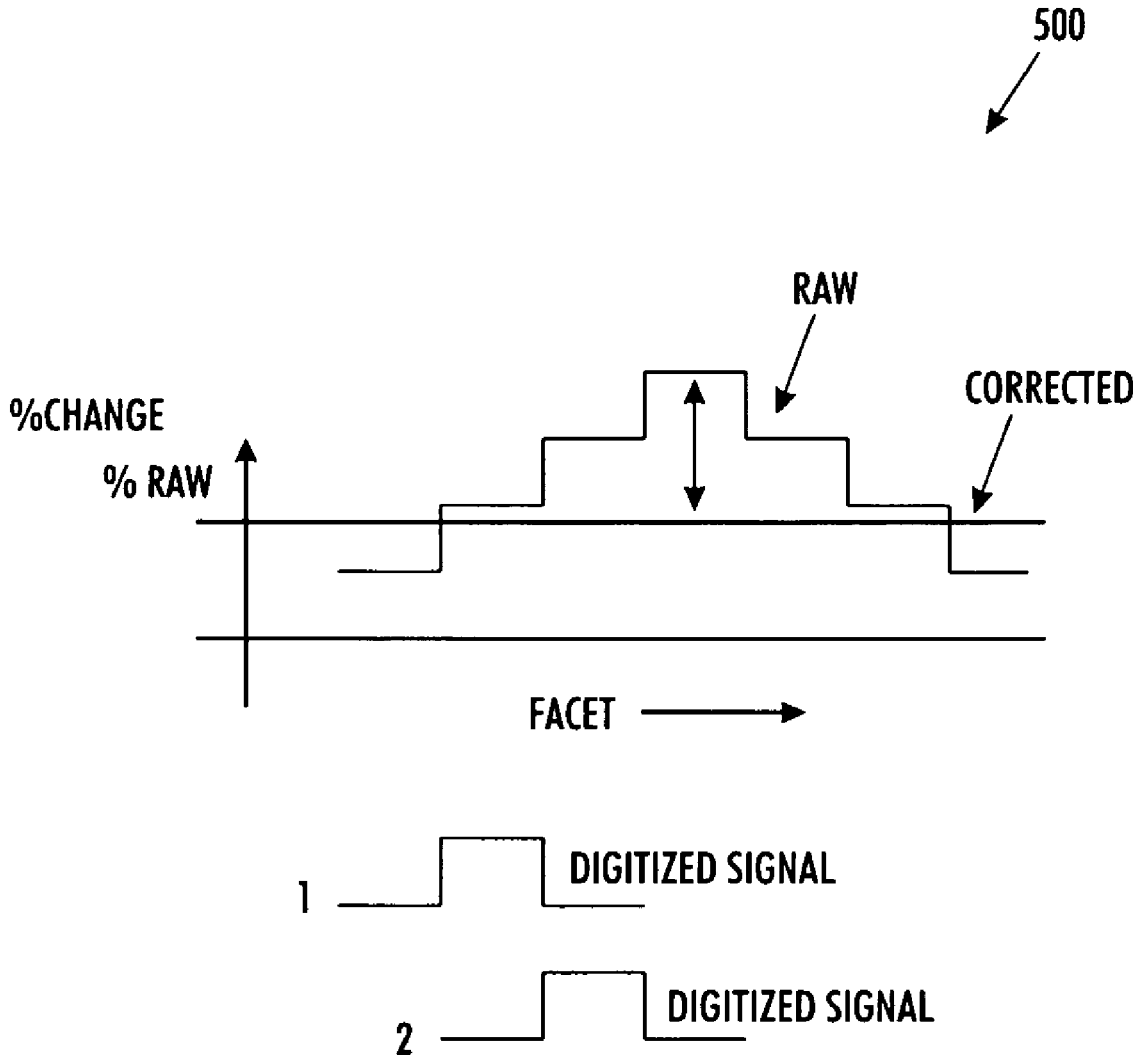
FIG. 5 illustrates the graphical representation of the response waveform of a raster scanner system, in accordance with a preferred embodiment.

Referring to FIG. 5, illustrated is a graphical representation 500 of the response waveform of a raster scanner system, in accordance with a preferred embodiment. The percentage of rise is analyzed in the vertical axis of the graph and the polygon facets are analyzed in the horizontal axis of the graph. The raw portion is shown in the graph. The digitized signal is also figured out from the graph representation.

It can be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of minimizing manufacturing errors in a motor polygon assembly via real time facet measurement and mapping, comprising:

providing an imaging system with at least one of a laser beam or array of beams, a rotating polygon assembly and an automatic power control;

configuring said rotating polygon assembly using a rotating polygon mirror and a polygon motor driver to generate a response that is utilized by said automatic power control to minimize motor polygon assembly output reflectivity through real time facet reflectivity measurement and mapping provided in conjunction with said automatic power control;

configuring control marks on said rotating polygon assembly, wherein said control marks are read by a reader during rotation of said rotating polygon assembly, and wherein said control marks provide pixel clock information, intensity correction information, error correction information regarding individual facets of said polygon assembly, and motor speed control information;

illuminating the motor polygon assembly using light from a laser beam;

monitoring laser beam reflections from the motor polygon assembly using said automatic power control;

monitoring said laser beams for errors during processing over scan periods outside of printing time frames using said automatic power control, wherein said errors detected by said automatic power control during period outside of printing time are recorded internal to a raster output scanner to minimize overall setup in image output manufacturing;

analyzing a percentage of rise in a vertical axis of a response waveform graph of said raster output scanner; and analyzing reflection from said facets in a horizontal axis of said response waveform graph to complete said measurement and mapping by correcting said output reflectivity of said laser beams.

2. A method of minimizing manufacturing errors in a motor polygon assembly during beam scanning comprising:

configuring control marks on said rotating polygon assembly, wherein said control marks are read by a reader during rotation of said rotating polygon assembly, and wherein said control marks provide pixel clock information, intensity correction information, error correction information regarding individual facets of said polygon assembly, and motor speed control information;

passing at least one laser beam onto facets of the rotating polygon mirror configured using a polygon motor driver to generate a response that is utilized by an automatic power control;

passing beam reflection from the rotating polygon mirror to said automatic power control adapted to sense laser beams;

using said rotating polygon mirror to minimize motor polygon assembly output reflectivity through real time facet reflectivity measurement and mapping provided in conjunction with said automatic power control;

monitoring said laser beams for errors using said automatic power control during processing over scan periods outside of printing timeframes, wherein said errors detected by said automatic power control during period outside of printing time are recorded internal to a raster output scanner to minimize overall setup in image output manufacturing;

analyzing a percentage of rise in a vertical axis of a response waveform graph of said raster output scanner; and analyzing reflection from said facets in a horizontal axis of said response waveform graph to complete said measurement and mapping by correcting said output reflectivity of said laser beams.

3. The method of claim 2 further comprising the step wherein information gathered from control marks during rotation of the rotating polygon mirror and read from the automatic power control is used to control the modulation of the exposing beam of an image forming apparatus to expose evenly spaced, uniformly sized, precisely oriented, geometrically straight scan lines of pixels on a photosensitive member.

4. An imaging system configured to minimize erratic motor polygon assembly (MPA) laser beam output reflectivity resulting from manufacturing errors in said MPA, comprising:

at least one laser beam;

a raster output scanner for image data processing;

an automatic power control sensor configured to monitor production from the laser beam during facet reflectivity wherein said automatic power control sensor monitors laser beams for errors during over scan periods outside of printing timeframes;

a rotating polygon mirror enabling facet reflectivity mapping when illuminated by the laser beam wherein said rotating polygon mirror minimizes motor polygon assembly output reflectivity through real time facet reflectivity measurement and mapping provided in conjunction with operation of said automatic power control sensor;

a main control section (CPU) integrated to an integrator that connects a light beam sensing unit with a light beam sensor output processing circuit;

a motor polygon assembly for providing rotation of the rotating polygon mirror and thereby enabling facet reflectivity mapping by the imaging system;

a memory wherein said errors in said laser beams detected by said automatic power control sensor are recorded internal to a raster output scanner to minimize overall setup in image output terminal manufacturing;

a vertical axis of a response waveform graph for analyzing a percentage of rise of said raster output scanner; and a horizontal axis of said response waveform graph for analyzing reflection from said facets to complete said measurement and mapping by correcting said output reflectivity of said laser beams.

* * * * *